US009613794B2

(12) United States Patent
Becker

(10) Patent No.: US 9,613,794 B2
(45) Date of Patent: Apr. 4, 2017

(54) EXTENDING LIGHT BULB REPLACING TOOL

(76) Inventor: John Becker, Laurel, MT (US)

( * ) Notice: Subject to any disclaimer, the term of this patent is extended or adjusted under 35 U.S.C. 154(b) by 1353 days.

(21) Appl. No.: 13/471,523

(22) Filed: May 15, 2012

(65) Prior Publication Data

US 2012/0222521 A1 Sep. 6, 2012

Related U.S. Application Data

(63) Continuation-in-part of application No. 12/507,112, filed on Jul. 22, 2009, now abandoned.

(60) Provisional application No. 61/084,649, filed on Jul. 30, 2008.

(51) Int. Cl.
*H01K 3/32* (2006.01)

(52) U.S. Cl.
CPC ..... *H01K 3/32* (2013.01)

(58) Field of Classification Search
CPC .. H01K 3/32; H01K 3/00; H01K 3/06; H01K 3/065; H01K 3/32; H01J 9/006; H01J 9/003; H01J 9/00; A47L 7/009; A47L 7/0085; A47L 9/244; A47L 9/242; F04B 33/0035; F04B 37/14; F04B 49/22; F04B 33/00
USPC ..... 81/53.11, 53.12; 417/234
See application file for complete search history.

(56) References Cited

U.S. PATENT DOCUMENTS 1,024,286 A * 4/1912 Santilli ..... H01K 3/32 16/433
1,655,979 A * 1/1928 Watkins ..... H01K 3/32 16/433
2,573,002 A 10/1951 Foster
2,607,620 A * 8/1952 Oliveri ..... H01J 9/003 101/407.1
2,634,998 A * 4/1953 Flower ..... H01K 3/32 248/363
2,983,541 A * 5/1961 Maki ..... H01K 3/32 294/184
3,788,693 A 1/1974 Farrington
4,021,068 A * 5/1977 Piazza ..... A63B 47/02 294/183
4,220,310 A 9/1980 Jantzen et al.
4,265,476 A * 5/1981 Elgart ..... B25B 11/007 269/21
4,397,491 A * 8/1983 Anderson ..... B65G 7/12 294/131

(Continued)

OTHER PUBLICATIONS

Vacuummounts.com; 2011 Copyright.

*Primary Examiner* — Hadi Shakeri
(74) *Attorney, Agent, or Firm* — James Ray & Assoc.

(57) ABSTRACT

An apparatus for changing a light bulb that is out of reach for a person even with the use of a six foot ladder includes a substantially hollow elongated member and an extendable member which is disposed within the substantially hollow elongated member. A locking member is engageable with the hollow member and the extendable member for adjusting the length of the apparatus. A replaceable vacuum cup having a predetermined shape is disposed on a first end of the extendable member for attachment to such light bulb. A vacuum pump is disposed adjacent a bottom portion of the hollow elongated member, such pump is engageable with the cup for creating a vacuum in the cup for securing such light bulb therein. A vacuum release assembly is disposed on the pump for releasing such vacuum.

13 Claims, 3 Drawing Sheets

(56) References Cited

U.S. PATENT DOCUMENTS

| | | | | | |
|---|---|---|---|---|---|
| 4,779,501 | A * | 10/1988 | Honda | H01J 9/006 | 29/271 |
| 4,930,824 | A | 6/1990 | Matthews et al. | | |
| 5,148,723 | A | 9/1992 | Newman, Sr. et al. | | |
| 5,218,889 | A * | 6/1993 | Brockberg | H01J 9/003 | 81/53.11 |
| 5,362,214 | A * | 11/1994 | Neward | F04B 37/14 | 251/243 |
| 5,398,811 | A | 3/1995 | Latella, Jr. | | |
| 5,628,538 | A | 5/1997 | Ericksen | | |
| 5,730,033 | A | 3/1998 | Mitrowski | | |
| 6,553,872 | B1 | 4/2003 | Tse et al. | | |
| 6,739,220 | B1 * | 5/2004 | Johnson | B25B 9/00 | 81/53.1 |
| 6,883,400 | B2 | 4/2005 | Sugano | | |
| 7,066,511 | B2 | 6/2006 | Newman et al. | | |
| 7,131,352 | B1 | 11/2006 | Saunders | | |
| 7,234,743 | B2 | 6/2007 | Robinson | | |
| 7,255,024 | B2 | 8/2007 | Johnson et al. | | |
| 7,334,503 | B1 * | 2/2008 | Newman | H01K 3/32 | 294/184 |
| 7,367,347 | B2 * | 5/2008 | Field | A45B 7/00 | 135/66 |
| 2003/0071405 | A1 * | 4/2003 | Miksovsky | B25B 1/22 | 269/95 |
| 2006/0229630 | A1 * | 10/2006 | Collins | A61F 2/4609 | 606/91 |
| 2012/0129128 | A1 * | 5/2012 | Carpenter | A61C 17/04 | 433/95 |

* cited by examiner

EXTENDING LIGHT BULB REPLACING TOOL

CROSS REFERENCE TO RELATED APPLICATIONS

This application is a Continuation-In-Part of U.S. patent application Ser. No. 12/507,112 filed Jul. 22, 2009, pending, and claiming priority from U.S. Provisional Patent Application Ser. No. 61/084,649 filed Jul. 30, 2008.

FIELD OF THE INVENTION

The present invention relates, in general, to a light bulb replacing tool, and, more particularly, the present invention relates to a light bulb replacing tool that can be used to replace light bulbs in high areas without using a ladder.

STATEMENT REGARDING FEDERALLY SPONSORED RESEARCH OR DEVELOPMENT

N/A

REFERENCE TO SEQUENCE LISTING, A TABLE, OR A COMPUTER PROGRAM LISTING COMPACT DISC APPENDIX

N/A

BACKGROUND OF THE INVENTION

Many businesses, homeowners and others must hire a professional to change light bulbs on their ceilings. Others that do not wish to pay another person may choose to replace bulbs on their own. This may cause them to drag out bulky ladders. These ladders, quite frequently, are unsafe to use or too heavy for some to carry. In order to reach the light bulbs, one may also have to move furniture, carpeting or other objects that may be in the way.

In other places such a work areas, schools gymnasiums or halls the ceilings may be sufficiently high and may require two employees to set up and move the ladders and scaffolding when changing bulbs. Companies can save money by being able to send only one person to do the job. Having a compact and efficient way to change bulbs may help users to do so, quickly and easily.

BRIEF SUMMARY OF THE INVENTION

The instant invention provides an apparatus for changing a light bulb that is out of reach for a person even with the use of a six foot ladder. The apparatus comprises a substantially hollow elongated tubular member having a predetermined shape, a predetermined size and a first predetermined length and formed of a first predetermined material. An extendable member is disposed within the substantially hollow elongated tubular member, the extendable member having a second predetermined length and formed of a second predetermined material. A locking means is engageable with the substantially hollow elongated tubular member and such extendable member for adjusting the length of the apparatus. A vacuum cup having a predetermined shape is disposed on a first end of the extendable member for attachment to such light bulb. Such vacuum cup is replaceable. A vacuum pump is disposed adjacent a bottom portion of the elongated tubular member and is in fluid communication with the vacuum cup for creating a vacuum in the cup for securing such light bulb therein. A vacuum release means is disposed on the pump for releasing the vacuum.

OBJECTS OF THE INVENTION

It is, therefore, one of the primary objects of the present invention to provide an apparatus for changing light bulbs that are in high places.

Another object of the present invention is to provide an apparatus that includes an extendable member to provide additional height.

Still another object of the present invention is to provide an apparatus that uses a vacuum pump to hold the bulb in place while the old bulb is removed and a new bulb inserted.

A further object of the present invention is to provide an apparatus that uses a manually operable vacuum pump to hold the bulb in place during removal and installation process.

In addition to the various objects and advantages of the invention which have been described in some specific detail above it should be noted that various other objects and advantages of the present invention will become more readily apparent to those persons who are skilled in the relevant art from the following more detailed description, particularly when such description is taken in conjunction with the appended claims.

BRIEF DESCRIPTION OF THE VARIOUS EMBODIMENTS OF THE INVENTION

Figure 1:
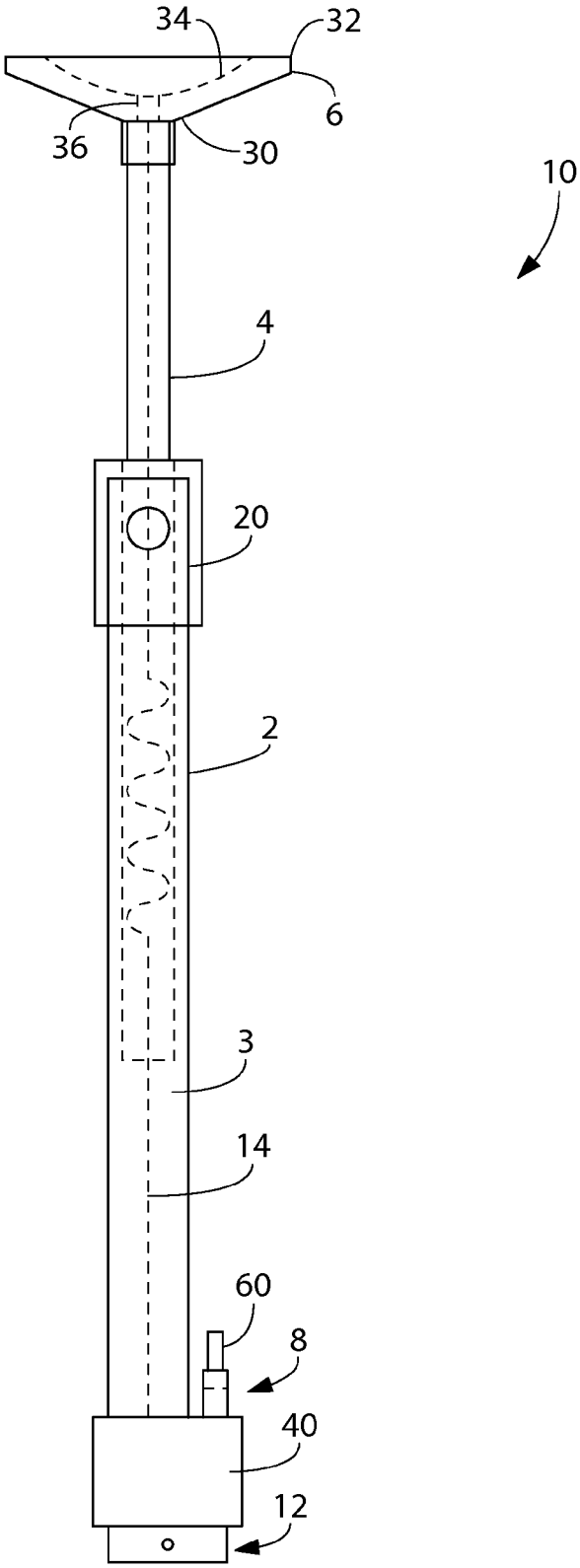
FIG. 1 is a front planar elevation of the apparatus for removing or installing a light bulb into an overhead socket.

Prior to proceeding with the more detailed description of the present invention it should be noted that, for the sake of clarity, identical components which have identical functions have been designated by identical reference numerals throughout the several views illustrated in the drawings.

Figure 2:
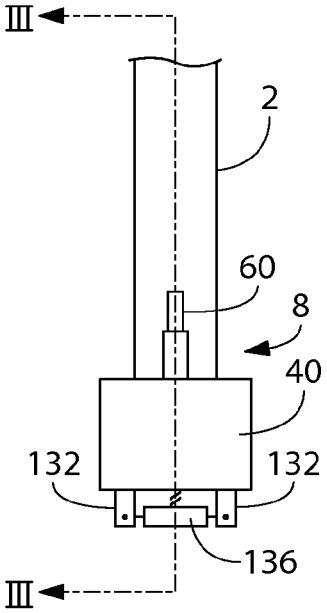
FIG. 2 is a partial side planar elevation view of the apparatus of FIG. 1.
Figure 3:
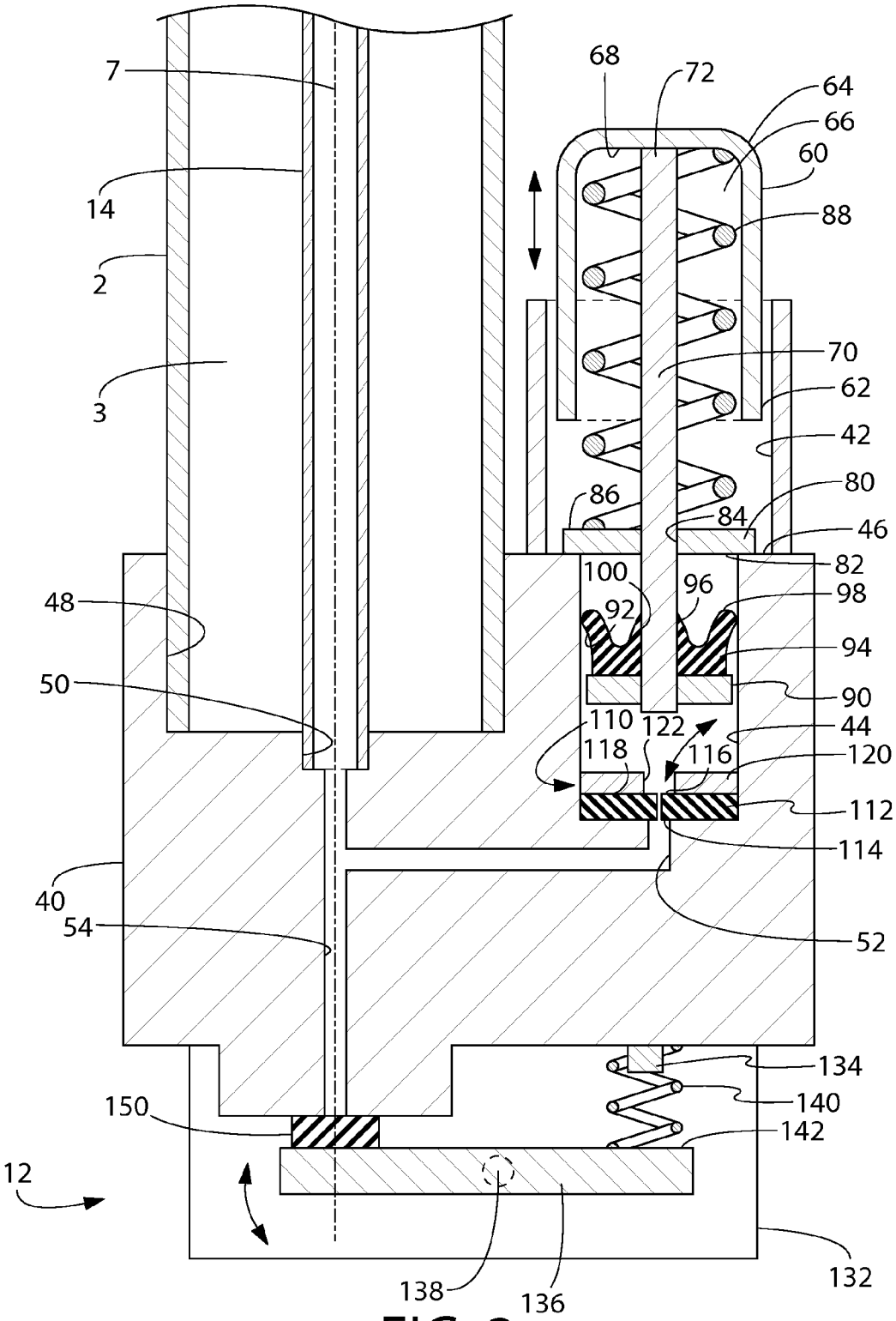
FIG. 3 is partial cross-sectional view of the apparatus of FIG. 1 along lines III-III of FIG. 2.

Now in reference to FIGS. 1-3, the instant invention provides an apparatus, generally designated as 10, for removing or installing a light bulb (not shown) that is out of reach for a person even with the use of a conventional six foot ladder. For example, such light bulb (not shown) is generally positioned in a recessed sealing light fixture (not shown). The apparatus 10 comprises a substantially hollow elongated tubular member having a predetermined size and a first predetermined length and formed of a first predetermined material. Preferably, such substantially hollow elongated tubular member is defined by a pair of members, first portion 2 and a second portion 4 which is disposed within the first portion 2 and which is linearly and telescopically extendable in relationship thereto. Thus, in the presently preferred embodiment, the substantially hollow elongated tubular member is configured as a variable length member.

A locking means 20 is engageable with the first portion 2 and the second portion 4 for adjusting the length of the apparatus 10 and temporarily securing the portions 2 and 4 at a preselected linear relationship therebetween. The instant invention contemplates that the locking means 20 is of any conventional locking arrangement for fixing a pair of telescopic members. A cup shaped member 6 has a predetermined shape, a first end 30 thereof attached to a first end of the extendable portion 4 and a second end 32 defining a concave interior surface 34 shaped and sized for abutting engagement with at least a portion of an exterior surface of the light bulb (not shown). An axial aperture 36 is provided in open communication with each of an exterior surface of the first end 30 and the concave interior surface 34 of the second end 32 for engagement with a peripheral surface of such light bulb (not shown). Such vacuum cup 6 is preferably configured as a replaceable member. At least partially coiled tubular member 14 extends through a hollow interior 3 of the substantially hollow elongated portion 2 and has a first end thereof connected to the axial aperture 36.

A pump, generally designated as 8, is disposed adjacent and attached to a bottom portion of an axially opposite end of the substantially hollow elongated portion 2, such pump 8 is connected in fluid communication to an opposite second end of the coiled tubular member 14 so as to generate a vacuum condition within the cup shaped member 6, the vacuum condition sufficient to temporarily securing such light bulb (not shown) therein.

Although the vacuum condition can be removed or released by simply prying the edge of the suction cup 6 from engagement with the peripheral surface of the light bulb (not shown), the instant invention advantageously provides a user operable vacuum release means 12 being preferably disposed on the pump 8 for removing or releasing the vacuum condition.

Now in a more particular reference to FIG. 3, the essential elements of the pump 8 include a body 40, a main bore defined within the body 40 and including a first bore (portion) 42 and a second bore (portion) 44 disposed coaxially with the first bore 42, a passageway 52 connecting the second bore 44 with a second end of the coiled tubing member 14, a plunger 60 mounted for a reciprocal linear movement within the first bore 42, the plunger manually movable into the body 40 so as to initiate removal of the air and release of the light bulb (not shown), a seal 92 mounted for movement within the second bore 44 and connected to the plunger 60, and a spring 88 configured to urge the plunger 60 in a direction away from the surface of the body 40 so as to remove the air.

A diameter of the second bore 44 is sized smaller than a diameter of the first bore 42. Thus, a shoulder 46 is formed at a juncture of the second and first bores, 44 and 42 respectively. There is a third bore 48 that is disposed within the body 40. The third bore 48 is sized and shaped to receive an exterior surface of the second end of the first portion 2. A fourth bore 50 is disposed axially with and external to the third bore 48. The fourth bore 50 is sized to receive, in a substantially sealed manner, an exterior surface of a second end of the coiled tubular member 14. The first passageway 52 connects the fourth bore 50 directly with the second bore 44 and, thus, essentially directly with the end of the coiled tubular member 14 disposed within such fourth bore 50. It is contemplated that the size of the cross-section of the first passageway 52 may any one of smaller equal or larger than the size of the cross-section of the fourth bore 50, depending on a specific application.

A second passageway 54 has one end thereof connected in fluid communication to the first passageway 52 and has an opposite end thereof connected in fluid communication to an exterior surface of the body 40. It is contemplated that the size of the cross-section of the second passageway 54 may any one of smaller equal or larger than the size of the cross-section of the first passageway 52, depending on a specific application.

The plunger 60 is mounted for a linear reciprocal motion within the first bore 42. The plunger 60 has an open first end 62, an axially opposite closed second 64 end and a hollow interior 66.

An elongated member 70 is disposed within the hollow interior 66 of the plunger 60 and has a first end 72 thereof attached to an interior surface 68 of the closed second end 64. The length of the elongated member 70 is so dimensioned that the elongated member 70 is disposed for a reciprocal linear movement within the first and second bores, 42 and 44 respectively.

A first disk shaped member or washer 80 is mounted on the elongated member 70 for movement thereon. The first disk shaped member 80 has one surface 82 thereof disposed in abutting engagement with the shoulder 46 during operation of the pump 8. The first disk shaped member 80 further has an axial aperture 84 sized to pass the elongated member 70 therethrough.

A first resilient member 88, shown by way of one example only as a coiled compression spring, is seated around the elongated member 70 between another surface 86 of the first disk shaped member 80 and the interior surface 68 of the closed second end 64 of the plunger 60. The first resilient member 88 may be also manufactured from an elastomeric material.

A second disk shaped member or washer 90 is rigidly mounted on the elongated member 70 for movement therewith in the second bore 44.

A first seal 92 is positioned between the first and second disk shaped members, 80 and 90 respectively, and has a disk shaped body 94, an abutment 96 disposed on one surface of the disk shaped body 94 coaxially therewith, a peripheral flange 98 inclined outwardly at an angle relative to the one surface of the disk shaped body 94, and an aperture 100 formed through the a thickness of each of the disk shaped body 40 and the abutment 96 so that the first seal 92 is mounted on the elongated member 70 for movement therewith. The first seal 92 is manufactured from rubber or from any other material suitable for air sealing purposes.

The second disk shaped member 90 is provided as an assurance for securing the first seal 92 on the elongated member 70 and may be otherwise excluded from the pump 8.

In operation, a repetitive reciprocal linear movement of the plunger 60 removes air between the concave interior surface 34 of the cup shaped member 30 and the exterior surface of the light bulb (not shown) through the at least partially coiled tubular member 14 so as to generate a vacuum condition within the cup shaped member 30, the vacuum condition sufficient to temporarily secure the light bulb (not shown) within the cup shaped member 30. The first seal 92 is so configured, that it permits air flow from the fourth bore 50 to the first bore 42 when the plunder 60 moves in a first direction into the body 40 and prevents air flow through contact between the peripheral flange 98 and the inner surface of the second bore 44 when the plunger 60 moves in a second direction away from the body 40. When the plunger 60 moves in the second direction, the vacuum is generated. It has been found that two (2) to four (4) cycles of the plunger 60 is usually sufficient to generate vacuum condition.

The instant invention also contemplates an optional check valve assembly, generally designated as 110, positioned within the second bore 44 and including a second seal 112 having one surface 114 thereof positioned in abutting engagement with a bottom of the second bore 44, a flap 116 disposed axially within a thickness of the second seal 112 and a third disk shaped member 120 positioned in abutting engagement with an opposite surface 118 of the second seal 112 and having an axial aperture 122 formed through a thickness thereof and having a diameter thereof being generally equal to a diameter of the flap 116. The check valve assembly 110 is configured to permit air flow only from the fourth bore 50 to the second bore 44.

Finally, the vacuum release assembly 12 includes a pair of abutments 132, preferably elongated, disposed on one exterior surface of the body 40 in a spaced apart relationship with each other, a spring seat 134 defined on the one surface between the pair of elongated abutments 132, a plate shaped member 136 positioned between the pair of elongated abutments 132 and being pivotally connected thereto at a pivot connection 138, a second resilient member, shown by way of one example only as compression coiled spring, 140 having one end thereof seated on the spring seat 134 and having a second end thereof positioned in abutting engagement with an inner surface 142 of the plate shaped member 136, a third seal 150 disposed on the inner surface 142 of the plate shaped member 140 in air sealing alignment with the second passageway 54, wherein a pivotal movement of the plate shaped member 136 about the pivotal connection 138 exposes the second passageway 54 to atmosphere and removes the vacuum condition. The plate shaped member 136 may be extended beyond the envelope of the body 40. Alternatively, the function of the above described vacuum release assembly 12 may be provided by a manually operable valve (not shown).

Preferably, the axis of the plunger 60 is disposed generally parallel to the longitudinal axis 7 of the portions 2 and 4, although other orientations of the plunger 60 are also contemplated. For example, plunger 60, with corresponding bores 42 and 44, spring 88, seal 92 and other components may be mounted perpendicular to the longitudinal axis 7 or even axially therewith by repositioning the vacuum release assembly.

In another form of the invention, when only a single elongated hollow member 2 is provided, the at least partially coiled tubular member 14 or the hollow interior 3 is replaced by a longitudinal bore 5 in operative alignment with the fourth bore 50 so that the first passageway 52 is then connected directly to the longitudinal bore 5 of the elongated hollow tubular member being in fluid communication with the interior of the suction cup 6. Furthermore, the fourth bore 50 may be illuminated in its entirety by connecting the first passageway 52 directly to the third bore 48, thus connecting the pump 8 in fluid communication with the hollow interior of the elongated hollow tubular member.

Figure 4:
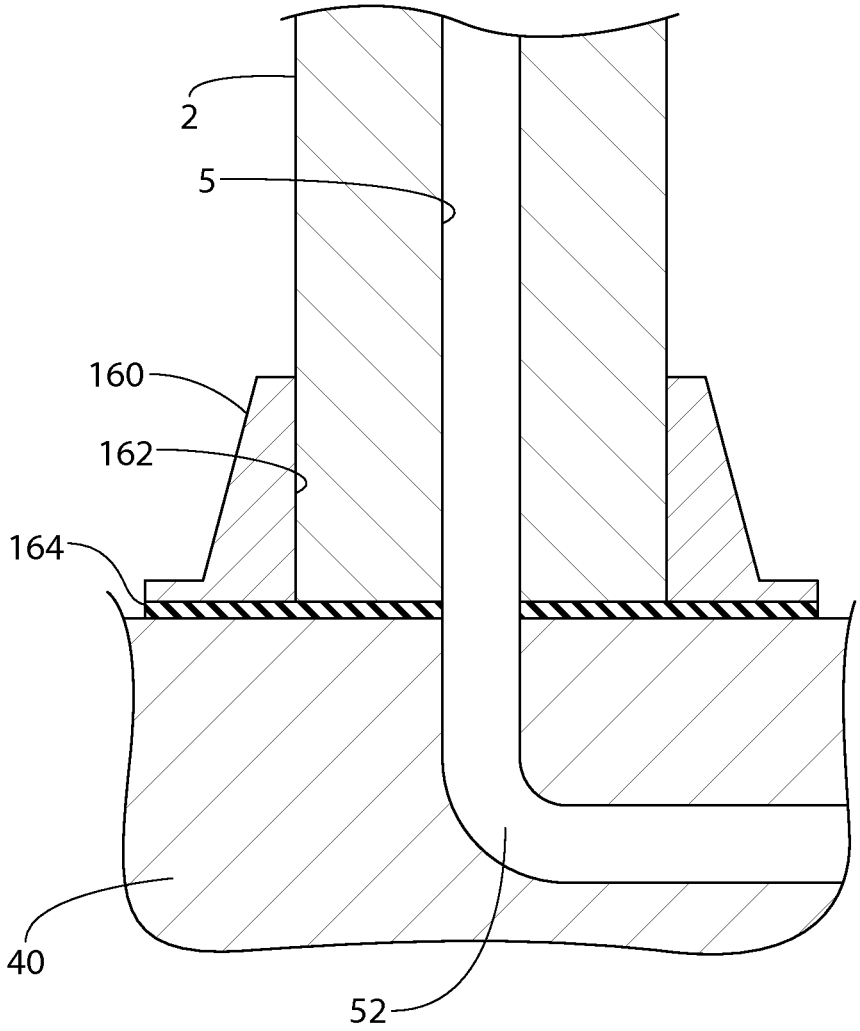
FIG. 4 is another partial side planar elevation view illustrating an alternative form of the apparatus of FIG. 1.

Now in reference to FIG. 4, it is further contemplated that the third bore 48 may be replaced with an abutment 160 on the surface of the body 40 and having a through axial aperture 162 sized to receive the exterior peripheral surface of the elongated hollow tubular member 2. The abutment 160 may be provided as a flange secured to the body 40 by any suitable means and may be further adapted with a sealing gasket 164.

The vacuum cup 6 can be made in different shapes to conform to different shaped light bulbs (not shown). As stated, the vacuum cup 6 is replaceable so the user can put on the cup 6 that corresponds to the shape of the light bulb (not shown). In a presently preferred embodiment of the invention such vacuum cup is manufactured from rubber material.

It is also presently preferred that material for forming the elongated portions 2 and 4 is selected from one of aluminum, plastic or fiberglass. It is even more preferred that such material is fiberglass.

While a presently preferred embodiment and alternate embodiments of the present invention have been described in detail above, it should be understood that various other adaptations and/or modifications of the invention can be made by those persons who are particularly skilled in the art without departing from either the spirit of the invention or the scope of the appended claims.

I claim:

1. An apparatus for aiding in removal or installation of a light bulb into a socket, said apparatus comprising:

(a) a substantially hollow elongated member;

(b) a cup shaped member having a first end thereof attached to a first end of said substantially hollow elongated member, a second end defining an interior surface shaped and sized for abutting engagement with at least a portion of an exterior surface of the light bulb and an axial aperture in open communication with each of an exterior surface of said first end and a convex interior surface of said second end, whereby said axial aperture being in fluid communication with a hollow interior of said substantially hollow elongated member;

(c) a pump attached to an axially opposite second end of said substantially hollow elongated member in fluid communication with said hollow interior thereof, said pump operable to remove air between said interior surface of said cup shaped member and the exterior surface of the bulb through said hollow interior so as to generate a vacuum condition within said cup shaped member, said vacuum condition sufficient to at least temporarily secure the bulb within said cup shaped member, said pump comprising:

a body, a bore defined within said body, a passageway connecting said bore with said hollow interior, a plunger mounted for a reciprocal linear movement within said bore, said plunger manually movable into said body so as to initiate removal of said air, a seal mounted for movement within said bore and connected to said plunger, and a spring configured to urge said plunger in a direction away from said body so as to remove said air; and (d) a vacuum removal assembly comprising:

a pair of elongated abutments disposed on one exterior surface of said pump in a spaced apart relationship with each other, a spring seat defined on said one surface between said pair of elongated abutments, a plate shaped member positioned between said pair of elongated abutments and being pivotally connected thereto, a spring having one end thereof seated on said spring seat and having a second end thereof positioned in an abutting engagement with an inner surface of said plate shaped member, a passageway within said body, said passageway connecting said hollow interior of said substantially hollow elongated member to atmosphere, a seal disposed on said inner surface of said plate shaped member in sealing alignment with said passageway, and a pivotal movement of said plate shaped member, selectively exposing said passageway to the atmosphere, is being configured to remove said vacuum condition.

2. The apparatus of claim 1, wherein said substantially hollow elongated member includes at least a pair of telescopically extending portions and a locking arrangement for at least temporarily securing said at least pair of telescopically extending portions at a preselected linear relationship therebetween.

3. The apparatus of claim 1, wherein said substantially hollow elongated member is configured as a variable length member.

4. The apparatus of claim 1, wherein said pump further includes an abutment on one surface thereof, said abutment having an axial aperture sized to receive a peripheral surface of said substantially hollow elongated member.

5. The apparatus of claim 1, wherein said pump further includes a flange secured to one surface thereof, said flange having an axial aperture sized to receive a peripheral surface of said substantially hollow elongated member.

6. The apparatus of claim 5, wherein said pump further includes a sealing gasket positioned between a surface of said flange and said surface of said pump.

7. The apparatus of claim 1, wherein said pump further includes another bore sized to receive a peripheral surface of said substantially hollow elongated member and wherein said passageway is connected to said another bore.

8. The apparatus of claim 1, further including at least partially coiled tubular member disposed within said hollow interior and extending therethrough, said at least partially coiled tubular member having a first end thereof connected to said axial aperture.

9. The apparatus of claim 1, wherein said substantially hollow elongated member includes a first member and second member positioned within said first member for a telescopic movement thereto.

10. The apparatus of claim 9, further including a locking member configured to lock a preselected position of said second member.

11. An apparatus for aiding in removal or installation of a light bulb into a socket, said apparatus comprising:

(a) a substantially hollow elongated member;

(b) a cup shaped member having a first end thereof attached to a first end of said substantially hollow elongated member, a second end defining an interior surface shaped and sized for abutting engagement with at least a portion of an exterior surface of the light bulb and an axial aperture in open communication with each of an exterior surface of said first end and a convex interior surface of said second end;

(c) at least partially coiled tubing member extending through a hollow interior of said substantially hollow elongated member and having a first end thereof connected to said axial aperture;

(d) a pump attached to an axially opposite second end of said substantially hollow elongated member and connectable to a second end of said coiled tubing member, said pump operable to remove air between said interior surface of said cup shaped member and the exterior surface of the bulb through said coiled tubular member so as to generate a vacuum condition within said cup shaped member, said vacuum condition sufficient to temporarily secure the bulb within said cup shaped member;

(e) a pair of elongated abutments disposed on one exterior surface of said pump in a spaced apart relationship with each other;

(f) a spring seat defined on said one surface between said pair of elongated abutments;

(g) a plate shaped member positioned between said pair of elongated abutments and is being pivotally connected thereto;

(h) a spring having one end thereof seated on said spring seat and having a second end thereof positioned in abutting engagement with an inner surface of said plate shaped member;

(i) a passageway connecting said hollow interior of said substantially hollow elongated member to the atmosphere;

(j) a seal disposed on said inner surface of said plate shaped member in sealing alignment with said passageway; and (k) wherein a pivotal movement of said plate shaped member, selectively exposing said passageway to atmosphere, removes said vacuum condition.

12. The apparatus of claim 11, wherein said pump includes:

(a) a body;

(b) a bore defined within said body;

(c) a passageway connecting said bore with said hollow interior;

(d) a plunger mounted for a reciprocal linear movement within said bore, said plunger manually movable into said body so as to initiate removal of said air;

(e) a seal mounted for movement within said bore and connected to said plunger; and (f) a spring configured to urge said plunger in a direction away from said body so as to remove said air.

13. An apparatus for aiding in removal or installation of a light bulb into a socket, said apparatus comprising:

(a) a substantially hollow elongated member;

(b) a cup shaped member having a first end thereof attached to a first end of said substantially hollow elongated member, a second end defining a concave interior surface shaped and sized for abutting engagement with at least a portion of an exterior surface of the light bulb and an axial aperture in open communication with each of an exterior surface of said first end and a convex interior surface of said second end;

(c) at least partially coiled tubular member extending through a hollow interior of said substantially hollow elongated member and having a first end thereof connected to said axial aperture;

(d) a pump including:

(i) a generally solid body, (ii) a first bore disposed within said body;

(iii) a second bore disposed within said body axially with and external to said first bore, a diameter of said second bore being smaller than a diameter of said first bore, (iv) a shoulder formed at a juncture of said second and first bores, (v) a third bore disposed within said body, said third bore sized and shaped to receive an exterior surface of said second end of said substantially hollow elongated member, (vi) a fourth bore disposed axially with and external to said third bore, said fourth bore sized to receive, in a substantially sealed manner, an exterior surface of a second end of said at least partially coiled tubular member, (vii) a first passageway connecting said fourth bore with said second bore;

(viii) a second passageway having one end thereof connected in fluid communication to said first passageway and having an opposite end thereof connected in fluid communication to an exterior surface of said body, (ix) a plunger mounted for a linear reciprocal motion within said first bore, said plunger having an open first end, an axially opposite closed second end and a hollow interior, (x) an elongated member disposed within said hollow interior of said plunger and having a first end thereof attached to an interior surface of said closed second end, said elongated member disposed for a reciprocal linear movement within said first and second bores, (xi) a first disk shaped member mounted on said elongated member for movement thereon, said first disk shaped member having one surface thereof disposed in abutting engagement with said shoulder during operation of said pump, said first disk shaped member further having an axial aperture sized to pass said elongated member therethrough, (xii) a first compression spring seated on said elongated member between another surface of said first disk shaped member and said interior surface of said closed second end of said plunger, (xiii) a second disk shaped member rigidly mounted on said elongated member for movement therewith within said second bore, (xiv) a first seal positioned between said first and second disk shaped members, said first seal having a disk shaped body, an abutment disposed on one surface of said disk shaped body coaxially therewith, a peripheral flange inclined outwardly at an angle relative to said one surface of said disk shaped body, and an aperture formed through a thickness of each of said disk shaped body and said abutment so that said first seal is mounted on said elongated member for movement therewith, and (xv) wherein a repetitive reciprocal movement of said plunger removes air between said concave interior surface of said cup shaped member and the exterior surface of the bulb through said coiled tubular member so as to generate a vacuum condition within said cup shaped member, said vacuum condition sufficient to temporarily secure the bulb within said cup shaped member;

(e) a check valve assembly positioned within said second bore and including:

(i) a second seal having one surface thereof positioned in abutting engagement with a bottom of said second bore, (ii) a flap disposed axially within a thickness of said second seal, and (iii) a third disk shaped member positioned in abutting engagement with an opposite surface of said second seal and having an axial aperture formed through a thickness thereof and having a diameter being generally equal to a diameter of said flap, (iv) said check valve assembly configured to permit air flow only from said forth bore to said second bore; and (f) a vacuum removal assembly including:

(i) a pair of elongated abutments disposed on said one exterior surface of said body in a spaced apart relationship with each other, (ii) a spring seat defined on said one surface between said pair of elongated abutments, (iii) a plate shaped member positioned between said pair of elongated abutments and is pivotally connected thereto, (iv) a second spring having one end thereof seated on said spring seat and having a second end thereof positioned in abutting engagement with an inner surface of said plate shaped member, (v) a third seal disposed on said inner surface of said plate shaped member in sealing alignment with said second passageway, and (vi) wherein a pivotal movement of said plate shaped member exposing said second passageway to atmosphere removes said vacuum condition.

* * * * *